US005610700A

United States Patent [19]

Yoshizuka

[11] Patent Number: 5,610,700

[45] Date of Patent: Mar. 11, 1997

[54] IMAGE FORMING APPARATUS INCLUDING A SYSTEM FOR COPYING AN IMAGE ON TWO DIFFERENT SHEET TYPES

[75] Inventor: Ken Yoshizuka, Osaka, Japan

[73] Assignee: Mita Industrial Co., Ltd., Osaka, Japan

[21] Appl. No.: 677,904

[22] Filed: Jul. 10, 1996

Related U.S. Application Data

[63] Continuation of Ser. No. 276,790, Jul. 18, 1994, abandoned.

[30] Foreign Application Priority Data

Jul. 21, 1993 [JP] Japan ..... 5-180321

[51] Int. Cl.[6] ..... G03G 15/00

[52] U.S. Cl. ..... 399/45; 399/382

[58] Field of Search ..... 355/321, 318, 355/311, 325, 308, 309, 323, 203–209; 271/9

[56] References Cited

U.S. PATENT DOCUMENTS

| | | | |
|---|---|---|---|
| 4,111,542 | 9/1978 | Mailloux et al. | 355/308 |
| 4,609,282 | 9/1986 | Crandall | 355/325 |
| 4,681,428 | 7/1987 | Devoy | 355/311 |
| 4,949,128 | 8/1990 | Parsons | 355/271 |
| 5,136,341 | 8/1992 | Takemura et al. | 355/311 |
| 5,237,382 | 8/1993 | Matsumura | 355/323 |
| 5,257,082 | 10/1993 | Kobayashi et al. | 355/325 |

*Primary Examiner*—Thu A. Dang

*Attorney, Agent, or Firm*—Beveridge, DeGrandi Weilacher & Young, LLP

[57] ABSTRACT

An image forming apparatus provides overhead projector (OHP) copies with interleaf sheets being provided on the back face thereof, while also providing normal paper copies of a desired number in a sorted state. When copies are made both on OHP sheets and on normal paper sheets, a desired number of normal paper copies is first input. Before a copy is made on an OHP sheet, an interleaf sheet is outputted into a bin of a sorter. The OHP sheet thereafter copied is outputted into this bin. The normal paper copies of the input number are made before or after the copying operation on the OHP sheets. The normal paper copies are sorted and outputted into sort bins of the sorter. Since the copying operations on OHP sheets and on normal paper are simultaneously performed, materials for a presentation can be readily prepared in a short time.

19 Claims, 4 Drawing Sheets

IMAGE FORMING APPARATUS INCLUDING A SYSTEM FOR COPYING AN IMAGE ON TWO DIFFERENT SHEET TYPES

This application is a continuation of application Ser. No. 08/276,790, filed Jul. 18, 1994, which application is entirely incorporated herein by reference, now abandoned.

BACKGROUND OF THE INVENTION

1. Field of the Invention

The present invention relates to an image forming apparatus such as a copying machine.

2. Description of the Prior Art

Conventionally, copying machines have been widely used which optically scan a document original, form an electrostatic latent image on a photoreceptor based on the scanned image of the document original, develop the electrostatic latent image into a toner image, and then transfer the toner image onto a sheet of copy paper. These copying machines, if necessary, are provided with an automatic document feeder for feeding document originals one by one, and with a sorter for sorting and outputting copy paper sheets into a plurality of sheet receiving trays when a plurality of copies are made from a single document original.

Such copying machines can form a copy image of a document original not only on a sheet of normal paper, but also on a transparent sheet for an OverHead Projector (hereinafter referred to as an "OHP sheet"). In general, since the image formed on a transparent OHP sheet is illegible, an interleaf sheet is attached onto the back face of the OHP sheet.

When a copy is made on an OHP sheet, an interleaf sheet is attached onto the back face of the OHP sheet by placing the interleaf sheet in the sheet receiving tray before the OHP sheet is outputted into the tray. When copies are made on a plurality of OHP sheets, however, interleaf sheets must be placed in the sheet receiving tray one by one before each of the OHP sheets is outputted into the tray. Performing such an operation manually is extremely troublesome. Therefore, a copying machine having an interleaving copy mode for automatically providing interleaf sheets on the back face of OHP sheets is conventionally used to make copies on the OHP sheets.

In the interleaving copy mode, an interleaf sheet is first discharged into the sheet receiving tray before a copy is made on an OHP sheet, and then the OHP sheet on which a copy image of a document original is formed is outputted onto the interleaf sheet. By repeating this operation, an interleaf sheet can be provided onto the back face of each of the plural OHP sheets.

In many cases, OHP sheets on which images are copied are used as a material for a presentation at a meeting, and in general, document materials which contain the same content as the OHP material are prepared for the participants in the meeting, typically so that the same number of copies are made as the number of participants. That is, normal paper copies are prepared in a number equivalent to the number of the participants.

In a conventional manner, copies are made on OHP sheets in the interleaving copy mode as mentioned above, and then on normal paper sheets by the desired number in a normal copy mode. In such case, if the copying machine has a sorter, a predetermined number of normal paper copies can be sorted and outputted into a plurality of sheet receiving trays.

A copying operation in the interleaving copy mode of the conventional copying machine, in most cases, needs to be followed by a copying operation in the normal paper copy mode. Therefore, the conventional copying machine is inconvenient for making copies both on OHP sheets and on normal paper sheets.

SUMMARY OF THE INVENTION

In order to solve the afore-mentioned problem in the prior art, it is an object of the present invention to provide an image forming apparatus which forms an image on a first-type sheet such as an OHP sheet while providing a third-type sheet onto the back face of the first-type sheet as an interleaf sheet, wherein the apparatus forms the same image on second-type sheets such as normal paper sheets by a desired number, and then sorts the second-type sheets on which the image is formed.

According to the present invention, when images are to be formed both on first-type sheets and on second-type sheets, the number of the second-type sheets on which the same image is formed can be preliminarily input. After the image is formed on the first-type sheet, the first-type sheet formed with the image is outputted into a specific one of plural sheet receiving sections. Every time a first-type sheet is outputted into the specific sheet receiving section, a third-type sheet is provided onto the first-type sheet.

After that, the same image as formed on the first-type sheet is formed on the second-type sheets by the number that has been input. The second-type sheets on which the image has been formed are sorted and outputted into sheet receiving sections other than the afore-said specific sheet receiving section.

Thus, the first-type sheet on which the image has been formed is obtained in the specific sheet receiving section with the third-type sheet being combined therewith, and the second-type sheets of the desired number on which the same image has been formed are sorted and outputted into the sheet receiving sections other than the specific sheet receiving section. That is, the image formation on the first-type sheet can be carried out concurrently with the image formation on the second-type sheets of the desired number.

If OHP sheets and normal paper sheets are respectively used as the first-type sheet and the second-type sheet, OHP sheet material as well as normal paper sheet material which contains the same content as the OHP material will be readily prepared for a presentation in a short time.

The foregoing and other objects, features, aspects and advantages of the present invention will become more apparent from the following detailed description of the present invention when taken in conjunction with the accompanying drawings.

DETAILED DESCRIPTION OF THE PREFERRED EMBODIMENTS

An embodiment of the present invention will be hereinafter described with reference to the accompanying drawings.

Figure 1:
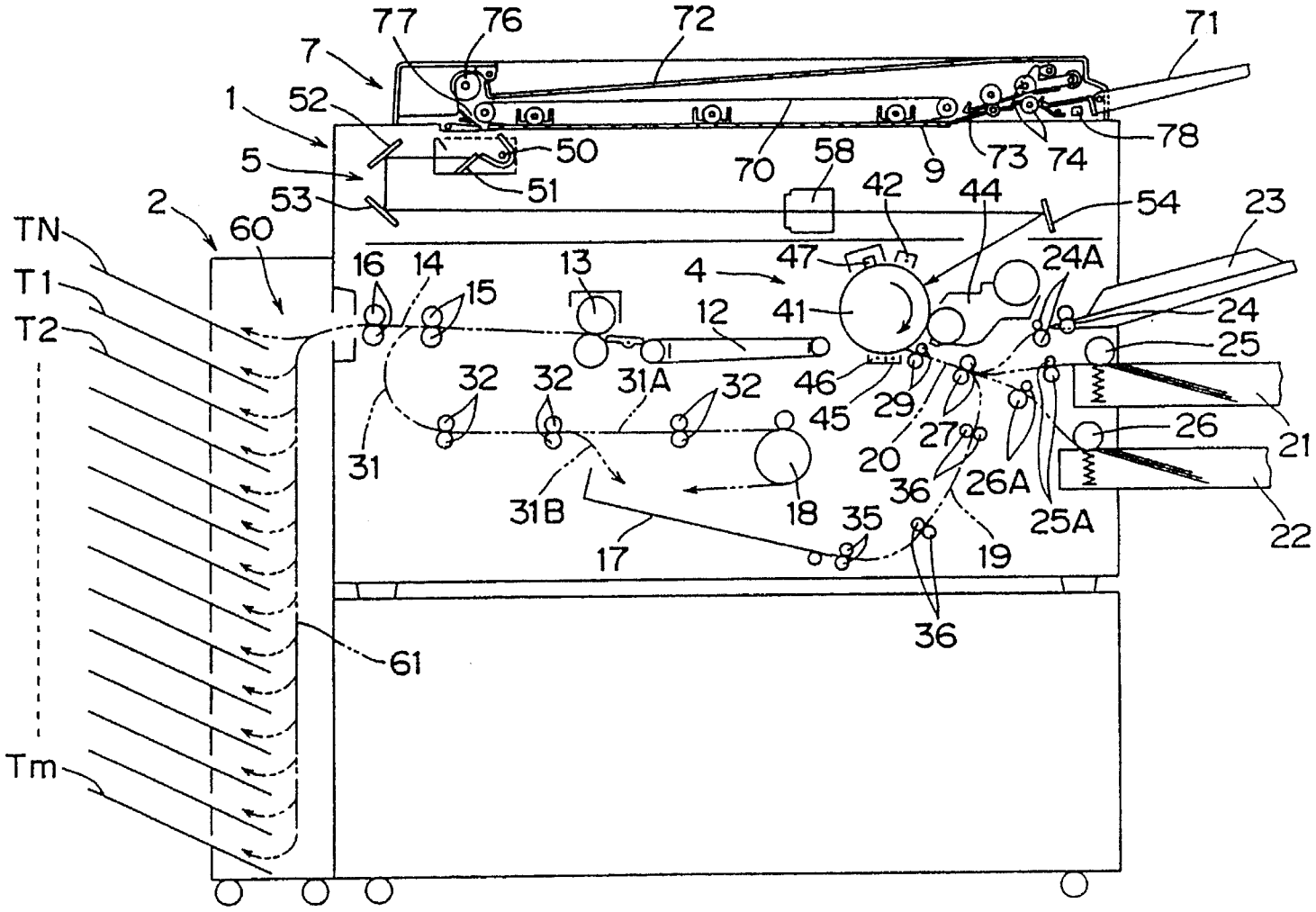
FIG. 1 is a schematic sectional view illustrating the inside structure of a copying machine in accordance with one embodiment of an image forming apparatus of the present invention.

FIG. 1 is a schematic view illustrating the structure of a copying machine in accordance with one embodiment of an image forming apparatus of the present invention. The copying machine comprises a main body 1, an automatic document feeder 7 mounted on the upper surface of the main body 1, and a sorter 2 for sorting and receiving copy sheets outputted from the main body 1 into a plurality of bins TN and T1 to Tm.

A transparent document platen 9 is disposed on the upper surface of the main body 1. A document original to be copied is placed on the document platen 9 with its upper face down. The automatic document feeder 7 serves as a means for automatically feeding a document original onto the document platen 9. The automatic document feeder 7 comprises a document feeding tray 71 in which document originals to be copied are set, and a pair of document feeding rollers 74 for taking out and feeding the document originals set in the document feeding tray 71 one by one into a sheet feeding path 73 extending to the document platen 9. The document original on the document platen 9 is conveyed by a document conveying belt 70. Upon completion of copying, the document original is discharged into a document receiving tray 72 through a document discharging path 77 by means of a document discharging roller 76. A document sensor 78 for detecting the presence of a document original in the document feeding tray 71 is disposed in the vicinity of the lower end of the document feeding tray 71.

In association with the document platen 9, a document reading section 5 is disposed within the main body 1. The document reading section 5 has a light source 50 for emitting light to the document original placed on the document platen 9 for scanning. The light source 50 is reciprocated laterally (as shown in FIG. 1) along the document platen 9, driven by a motor for the optical system (not shown). Light emitted from the light source 50 is reflected on the document original placed on the document platen 9. The reflected light from the document original is reflected on a first reflector mirror 51 driven together with the light source 50, then reflected on a second reflector mirror 52, a third reflector mirror 53 and on a fourth reflector mirror 54, and is guided to a photoreceptor drum 41 provided in an image forming section 4. In association with the movement of the light source 50, the second reflector mirror 52 and the third reflector mirror 53 are laterally moved (as shown in FIG. 1) at a speed half the speed of the light source 50. Therefore, the length of a light path between the light source 50 and the photoreceptor drum 41 is always kept constant during the scanning process where the document original is scanned with the light from the light source 50. A zoom lens 58 is disposed between the third reflector mirror 53 and the fourth reflector mirror 54 for forming an image of the document original on the photoreceptor drum 41.

The image forming section 4 comprises the photoreceptor drum 41 which is rotated at a constant speed during the formation of an image, a discharger 42, a developing unit 44, image transfer unit 45, a separator 46 and a cleaning unit 47 which are disposed along the rotational direction around the photoreceptor drum 41 in the order named.

The surface of the photoreceptor drum 41 is uniformly charged by the electric discharge of the discharger 42, and then exposed to the reflected light from the document original. As a result, an electrostatic latent image corresponding to an inverted image of the document original is formed on the surface of the photoreceptor drum 41. The electrostatic latent image is developed into a toner image by means of the developing unit 44. The toner image is transferred onto a copy sheet by means of the image transfer unit 45. The residual toner which remains on the surface of the photoreceptor drum 41 after the toner image is transferred is removed by means of the cleaning unit 47. The separator 46 serves to separate the copy sheet from the surface of the photoreceptor drum 41. The image transfer unit 45 and the separator 46 perform their individual functions by discharging corona.

In synchronization with the image formation in the image forming section 4, a copy sheet is fed from either of sheet feeding cassettes 21 and 22, or from a manual sheet feeding tray 23. Two different-sized copy sheets are each accommodated in the sheet feeding cassettes 21 and 22. Sheet feeding rollers 24, 25 and 26 for taking out copy sheets one by one are provided in association with the manual sheet feeding tray 23 and sheet feeding cassettes 21 and 22. During the copying operation, one of the sheet feeding rollers 24, 25 and 26 is rotated to feed a copy sheet to a sheet conveying path 20 from the corresponding one of the sheet manual feeding tray 23 and the sheet feeding cassettes 21 and 22. A pair of conveyor rollers 27 for conveying the copy sheet are disposed in the sheet conveying path 20. A pair of rollers 24A, 25A and 26A are sheet separation rollers for preventing sheets from sticking with each other in sheet feeding process.

The sheet conveying path 20 extends closely to the photoreceptor drum 41. A pair of resist rollers 29 are provided in the vicinity of the photoreceptor drum 41 in the sheet conveying path 20. These resist rollers 29 once stop the copy sheet, and then feed it to the photoreceptor drum 41 in synchronization with the rotation of the photoreceptor drum 41. Accordingly, the copy sheet is fed to the photoreceptor drum 41 in such a timing as to be registered with the toner image formed on the surface of the photoreceptor drum 41 at the location of the image transfer unit 45.

The copy sheet on which the toner image has been transferred by means of the image transfer unit 45 is separated from the surface of the photorecepter drum 41 by the separator 46, and then guided to a fixing unit 13 by a sheet conveying belt 12. The fixing unit 13 fixes the toner image on the surface of the copy sheet. After the fixing process, the copy sheet is conveyed through a sheet outputting path 14 to the sorter 2 by pairs of conveyor rollers 15 and sheet outputting rollers 16.

The sheet outputting path 14 branches into a path 31 for guiding the copy sheet to an intermediate tray 17 disposed at the lower part within the main body 1. Pairs of sheet conveying rollers 32 are disposed at appropriate intervals in the path 31. The path 31 branches into two paths 31A and 31B in the vicinity of the entrance of the intermediate tray 17. Near the ending portion of the path 31A, a pair of sheet reversing rollers 18 are provided for reversing the copy sheet to be accommodated in the intermediate tray 17 in a reversed state. The path 31B is provided for guiding the copy sheet to the intermediate tray 17 without reversing the copy sheet.

The copy sheets accommodated in the intermediate tray 17 are taken out one by one by means of a pair of sheet feeding rollers 35, and guided to a sheet conveying path 19 joining the sheet conveying path 20. Pairs of sheet conveying rollers 36 are disposed at appropriate intervals in the sheet conveying path 19.

The intermediate tray 17 is used in a both-face copy mode wherein copy images are formed on the both faces of a copy sheet, and in an image combining mode wherein plural images from different document originals are combined on one face of a copy sheet. In the both-face copy mode, after a copy is made on one face of a copy sheet, the copy sheet is guided through the sheet outputting path 14 to the path 31 and then to the path 31A, in which the copy sheet is reversed to be accommodated in the intermediate tray 17. Then the copy sheet is conveyed from the intermediate tray 17 through the sheet conveying paths 19 and 20, and again guided to the photoreceptor drum 41. In the image combining mode, after a copy image is formed on a copy sheet, the copy sheet is conveyed from the sheet outputting path 14 to the path 31, and then guided through the path 31B to the intermediate tray 17. The copy sheet is then fed from the intermediate tray 17 to the photoreceptor drum 41 again.

The sorter 2 comprises a plurality of bins TN and T1 to Tm as previously mentioned, and further comprises a sorting mechanism 60 for sorting and outputting copy sheets outputted from the main body 1 into the bins TN and T1 to Tm. The sorting mechanism 60 has a path 61 extending to each of the bins TN and T1 to Tm, and path switching means not shown for switching the sheet conveying path to output the copy sheet outputted from the main body 1 into any one of the bins.

Among the plural bins TN and T1 to Tm, the bin TN is a non-sort bin which is used when copy sheets are outputted without being sorted after copies are made. The bins T1 to Tm are used as sort bins to which copy sheets are sorted and outputted after copies are made.

The copy sheets which can be used in the copying machine according to this embodiment include normal paper sheets used as the second-type copy sheet and OHP sheets used as the first-type copy sheet. When OHP sheets are used as copy sheets, the interleaving copy mode is selected wherein interleaf sheets used as the third-type sheet are added onto the back face of copied OHP sheets. In this case, the OHP sheets are fed from the sheet manual feeding tray 23, and the interleaf sheets are fed from either of the sheet feeding cassettes 21 or 22.

In the interleaving copy mode, the OHP sheets and interleaf sheets are outputted into the non-sort bin TN. Copies are simultaneously made both on the OHP sheets and on the normal paper sheets. In this case, normal paper sheets are sorted and outputted into sort bins T1 to Tm after copies are made thereon.

Figure 2:
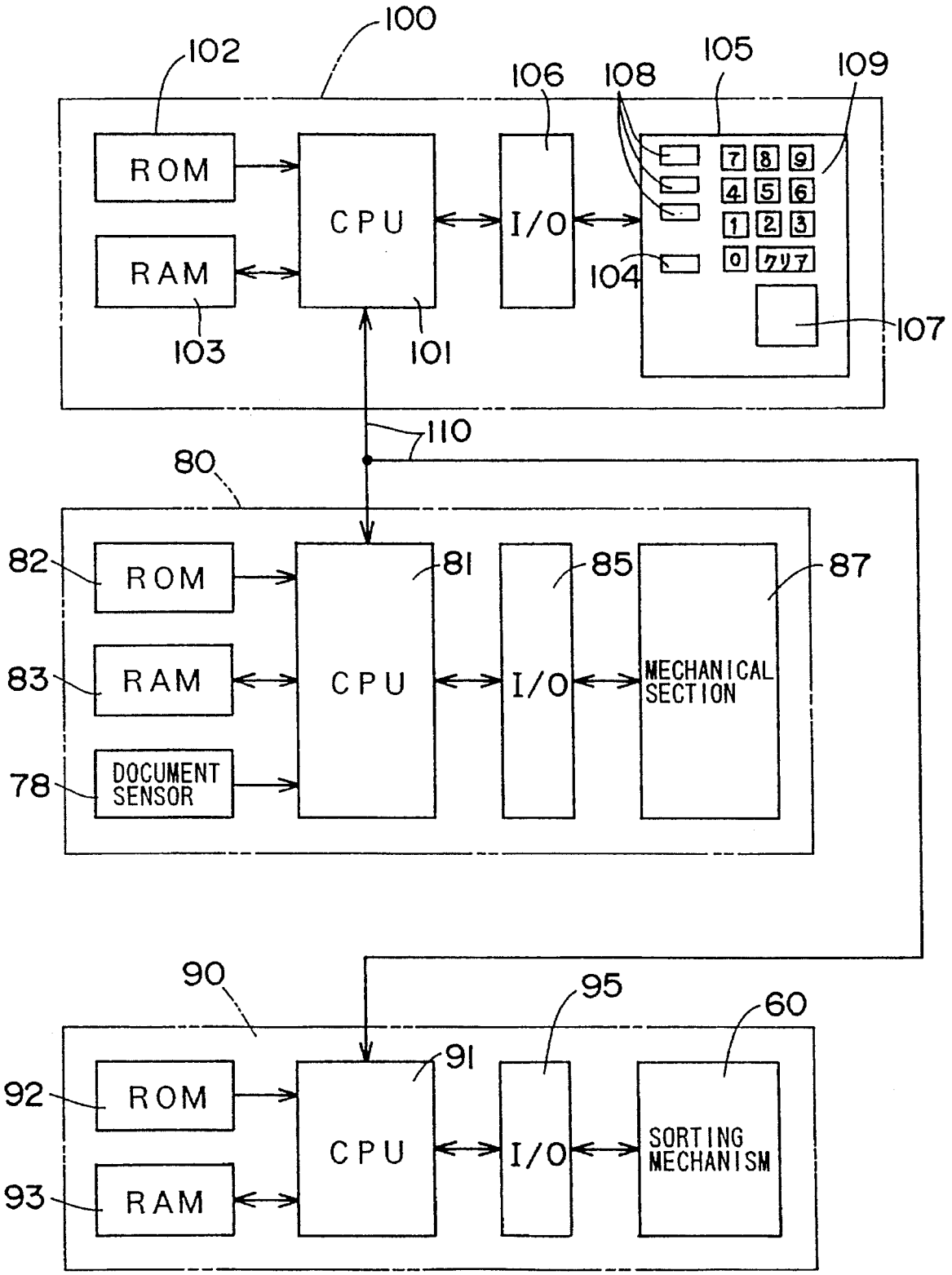
FIG. 2 is a block diagram illustrating the electrical configuration of the copying machine shown in FIG. 1.

FIG. 2 is a block diagram illustrating the electrical configuration of the aforesaid copying machine. A copying machine controlling section 100 for controlling the operations of individual members provided in the main body 1 is connected via a serial communications line 110 to an ADF (Automatic Document Feeder) controlling section 80 for controlling the operation of the automatic document feeder 2 and a sorter controlling section 90 for controlling the operation of the sorter 3.

The copying machine controlling section 100 comprises a CPU (Central Processing Unit) 101, a ROM (Read Only Memory) 102 for storing operation programs for the CPU 101 and a RAM (Random Access Memory) 103 to be used as a work area. The CPU 101 is connected via an I/O (Input and/or Output) interface 106 to an operation panel 105 provided on the top face, for example, of the main body 1. The operation panel 105 comprises a print key 107 for starting the copying operation, mode setting keys 108 for setting a copy mode such as the above-mentioned interleaving copy mode, ten keys 109 for inputting a copying number and the like and a cassette selection key 104 for selecting a sheet feeding cassette. The operation panel 105 further comprises a display not shown for displaying the selected mode, copying number and so on.

The ADF controlling section 80 comprises a CPU 81, a ROM 82 for storing the operation programs for the CPU 81, and a RAM 83 to be used as a work area when the CPU 81 performs the processing operation. The CPU 81 is connected to the output of the document sensor 78 for checking the presence of a document original set in the document feeding tray 71. The CPU 81 controls a mechanical section 87 via an I/O interface 85. The mechanical section 87 includes a motor, a plurality of clutches for transmitting driving forces from the motor to the document conveying belt 70, the document feeding rollers 74 and the document discharging rollers 76, and a solenoid for switching the document feeding path.

Similarly, the sorter controlling section 90 comprises a CPU 91, a ROM 92 and a RAM 93. The CPU 91 controls the aforementioned sorting mechanism 60 via an I/O interface 95.

The CPU 101 of the copying machine controlling section 100 sends a signal to the ADF controlling section 80 via the serial communications line 110 to instruct the replace and discharge of document originals, and the CPU 81 of the ADF controlling section 80 controls the mechanical section 87 based on the signal sent from the copying machine controlling section 100, whereby the replacement and discharge of document originals are accomplished. The CPU 81 inputs information indicative of the presence of an unprocessed document original to the copying machine controlling section 100 via the communications line 110, based on the output of the document sensor 78.

Every time a copy sheet is outputted to the sorter 2, the copying machine controlling section 100 sends a sheet outputting signal to the sorter controlling section 90 in a timing immediately before the output of the copy sheet. The sheet outputting signal is a signal for instructing the sorter controlling section 90 that the copy sheet is to be outputted to the sorter 3. The copying machine controlling section 100 also sends the sorter controlling section 90 a signal indicative of which bin, the non-sort bin TN or the sort bins T1 to Tm, the copy sheet is outputted to. When the last copy sheet on which an image from a single document original is formed is outputted, the copying machine controlling section 100 sends the sorter controlling section 90 a signal indicative that the copy sheet to be outputted is the last one.

Figure 3:
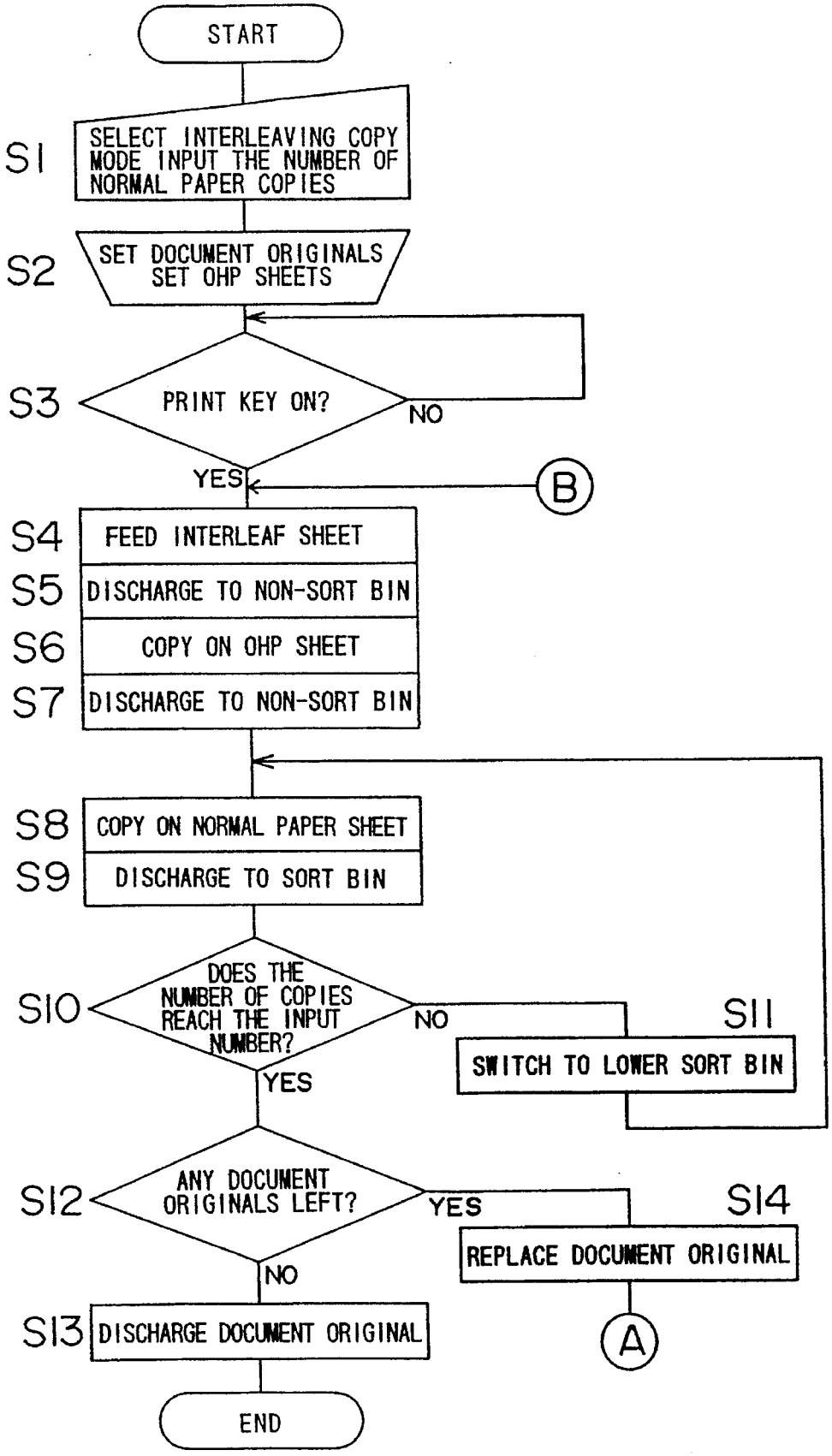
FIG. 3 is a flow chart illustrating the operations of the copying machine shown in FIG. 1.
Figure 4:
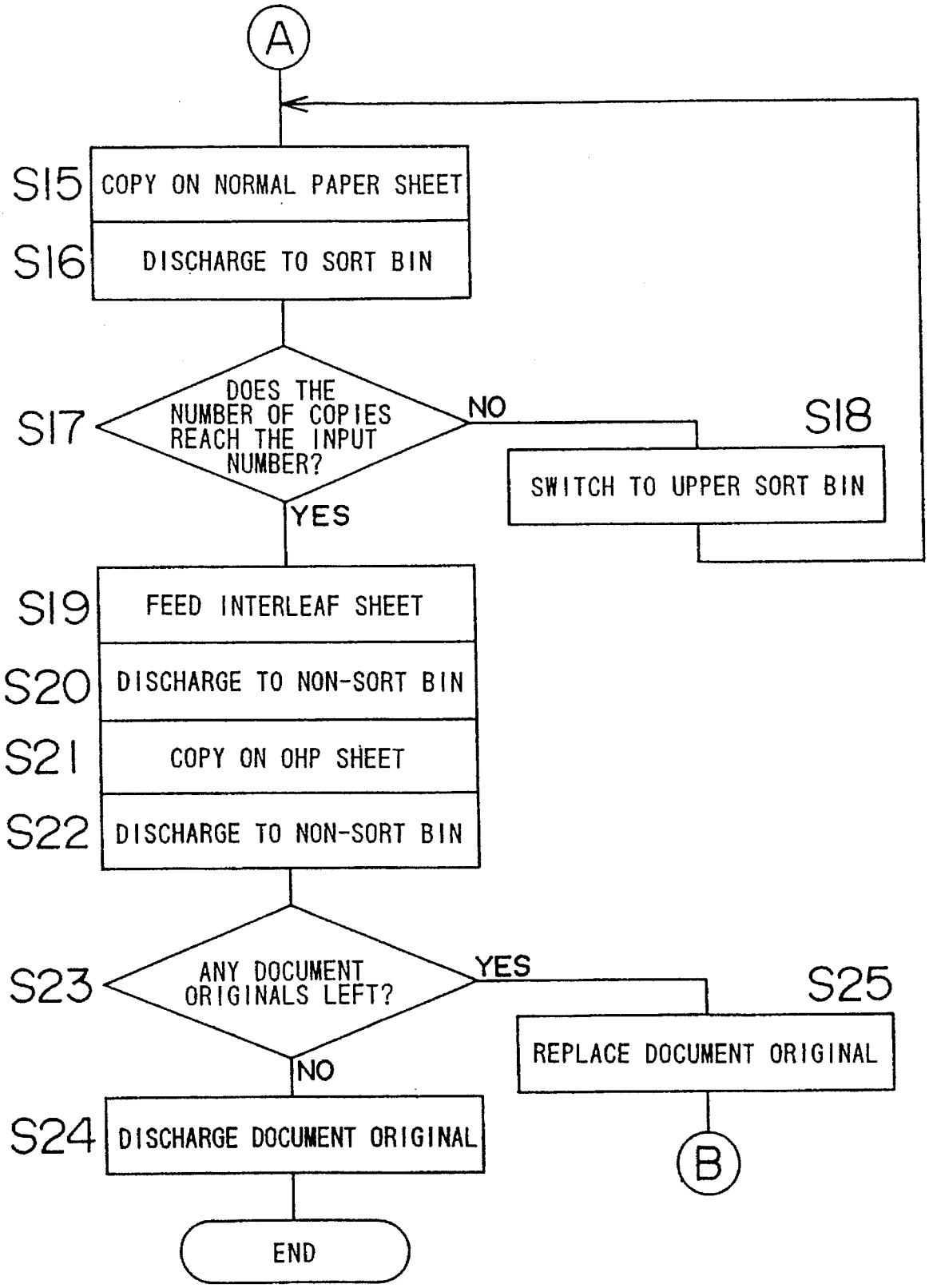
FIG. 4 is a flow chart illustrating the operations of the copying machine shown in FIG. 1.

FIGS. 3 and 4 are flow charts illustrating the operations of the copying machine when OHP sheets are used as copy sheets in the interleaving copy mode. An operator inputs necessary settings on the operation panel 105 (step S1). That is, the operator selects the interleaving copy mode as a copy operation mode, selects a sheet feeding cassette from which interleaf sheets are supplied, inputs the desired number of normal paper copies by using the ten keys 109, and then selects a sheet feeding cassette accommodating the normal paper sheets. When normal paper sheets are used both as the copy sheets and as the interleaf sheets, the operator may select only the sheet feeding cassette accommodating the normal paper sheets.

The operator sets document originals in the document feeding tray 71 of the automatic document feeder 7, and then OHP sheets in the sheet manual feeding tray 23 (step S2).

When the operator presses the print key 107 to start the copy operation (step S3), an interleaf sheet is taken out of the sheet feeding cassette selected in step S1 and conveyed to the sorter 2 through the sheet conveying path 20 and sheet outputting path 14 inside the main body 1 (step S4). At this time, the image forming operation is not carried out by means of the document reading section 5 and the image forming section 4 inside the main body 1. That is, an interleaf sheet on which no image is formed is sent to the sorter 2. At this time, the copying machine controlling section 100 sends the sorter controlling section 90 a signal indicative that the interleaf sheet is to be outputted into the non-sort bin TN (step S5), whereby the interleaf sheet is outputted into the non-sort bin TN.

A copy sheet accommodated in the sheet manual feeding tray 23, i.e. an OHP sheet, is fed to the photoreceptor drum 41, and then a copy is made on the OHP sheet (step S6). After that, the copying machine controlling section 100 sends the sorter controlling section 90 a signal indicative that the OHP sheet is to be outputted into the non-sort bin TN (step S7), whereby the copied OHP sheet is outputted into the non-sort bin TN. Therefore, the copied OHP sheet is outputted onto the interleaf sheet which has been outputted into the non-sort bin TN, whereby the interleaf sheet is attached onto the back face of the OHP sheet outputted.

A normal paper sheet is fed from the sheet feeding cassette selected for the copying on normal paper sheets, and then a copy is made on this normal paper sheet (step S8). When the normal paper copy is outputted, the copying machine controlling section 100 sends the sorter controlling section 90 a signal indicative that the normal paper copy is to be outputted to one of the sort bins T1 to Tm (step S9).

In step S10, it is judged whether the copying operation has finished with the normal copy sheets based on the number input in step S1. If not, the sort bin is switched to the next lower bin (see FIG. 1) to which a normal paper copy is next to be outputted, controlled by the sorter controlling section 90 (step S11). After that, the copying process returns to step S8.

The steps S8 to S11 are repeated until the copying operation has finished with normal paper sheets based on the input number. The sort bins are downwardly switched one after another (see FIG. 1), and normal paper copies made from a single document original are distributed one by one to the sort bins in a number equivalent to the input number. For example, if the input number is k (k is an integer and $1 \leqq k \leqq m$, wherein m is the total number of sort bins), normal paper copies are outputted one by one into the sort bins T1 to Tk, and then the copying operation is stopped when the sort bin Tk is selected.

When normal paper copies of the input number have been made, it is judged whether any document original is present in the document feeding tray 71 of the automatic document feeder 7 in step S12. If no document original is left, the last document original on the document platen 9 is discharged into the document receiving tray 72 (step S13), and then the copying operation is finished. If there are any document originals to be copied, the document original is replaced with the next one in step S14, and then the process enters into step S15 shown in FIG. 4.

In step S15, a normal paper sheet is fed from the sheet feeding cassette selected for the copying on normal paper sheets, and then a copy is made on this normal paper sheet. When the normal paper copy is outputted, the copying machine controlling section 100 sends the sorter controlling section 90 a signal indicative that the normal paper copy is to be outputted into a sort bin in step S16, whereby the normal paper copy is outputted into the sort bin Tk.

In step S17, it is judged whether the copying operation has finished with the normal paper sheets of the input number. If not, the sort bin is switched to the next upper bin in step S18, and then the copying process returns to step S15. The steps S15 to S18 are repeated until the copying operation has finished with normal paper sheets of the input number, and normal paper copies made from a single document original are distributed one by one to the sort bins T1 to Tk.

When normal paper copies of the input number have been made, an interleaf sheet is fed from the sheet feeding cassette accommodating the interleaf sheets, and then the interleaf sheet is outputted with no image being formed thereon (step S19). At this time, the copying machine controlling section 100 sends the sorter controlling section 90 a signal indicative that the interleaf sheet is to be outputted into the non-sort bin TN (step S20). After that, an OHP sheet is fed from the sheet manual feeding tray 23, and a copy is made thereon (step S21). When the copied OHP sheet is outputted, the copying machine controlling section 100 sends the sorter controlling section 90 a signal indicative that the copied OHP sheet is to be outputted into the non-sort bin TN (step S22). As a result, the copied OHP sheet is outputted onto the interleaf sheet in the non-sort bin TN.

Then, it is judged whether any document original is present in the document feeding tray 71 of the automatic document feeder 7 (step S23). If no document original is left, the last document original is discharged (step 24), and then the copying operation is finished. If there are any document originals to be copied, the document original is replaced with the next one in step S25, and then the process returns to step S4 shown in FIG. 3.

According to the aforesaid preferred embodiment of the present invention, OHP sheet copies are obtained with interleaf sheets being attached on the back face thereof, and at the same time, normal paper copies of a desired number are obtained in a sorted state only by inputting the desired number of normal paper copies in the interleaving copy mode. Therefore, the present invention eliminates the need for separately performing the copying operations on OHP sheets and on normal paper sheets. Accordingly, materials necessary for a presentation can be readily prepared in a short time.

Although the present invention has been described with respect to a specific preferred embodiment thereof, it should be understood that the present invention is not limited thereto. For example, although OHP sheets and interleaf sheets are outputted into the non-sort bin TN according to the aforesaid preferred embodiment, these sheets may be outputted into any of the sort bins T1 to Tm (preferably the uppermost bin T1).

Further, although the aforesaid preferred embodiment takes an example of a copying machine, the present invention is also applicable to other image forming apparatuses such as laser beam printers which are used to form the same images both on OHP sheets and on normal paper sheets.

Therefore, it is intended that the present invention encompasses various changes and modifications as fall within the scope of the appended claims.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus for forming an image on two types of sheets, comprising:

an input means for inputting a number of sheets on which an image is to be formed;

an image forming means for forming the image on a first-type sheet and for forming the image on at least one second-type sheet, wherein the image is formed on a number of second-type sheets corresponding to the number input by the input means;

a plurality of sheet receiving sections to which the sheets formed with the image are outputted;

a means for outputting the first-type sheet on which the image is formed by the image forming means into a predetermined one of the sheet receiving sections;

a means for sorting and outputting the second-type sheets on which the image is formed by the image forming means into the sheet receiving sections other than the predetermined sheet receiving section; and a sheet adding means for attaching a third-type sheet onto each first-type sheet outputted into the predetermined sheet receiving section, wherein, in a single image forming operation sequence, the image forming apparatus thereby produces one set of first-type sheets carrying an image corresponding to an image on an original document set, and at least one set of second-type sheets also carrying the image corresponding to the image on the original document set.

2. The image forming apparatus according to claim 1, further including:

a first sheet storing means for storing a plurality of sheets of the first-type;

a second sheet storing means for storing a plurality of sheets of the second-type; and a sheet feeding means for selectively feeding the first-type sheet stored in said first sheet storing means or the second-type sheet stored in said second sheet storing means into the image forming means in association with an image forming operation of said image forming means.

3. The image forming apparatus according to claim 2, wherein the second-type sheet and the third-type sheet are of a common type.

4. The image forming apparatus according to claim 3, wherein said sheet feeding means feeds the sheets stored in the second sheet storing means into said sheet adding means.

5. The image forming apparatus according to claim 2, wherein said first sheet storing means includes a manual sheet feeding tray by which sheets of the first-type are manually supplied.

6. The image forming apparatus according to claim 5, wherein said second sheet storing means includes a sheet feeding cassette accommodating a large number of sheets.

7. The image forming apparatus according to claim 5, wherein the first-type sheet is a transparent sheet for an overhead projector and the second-type sheet is a sheet of paper.

8. The image forming apparatus according to claim 2, further including an automatic document feeding means for automatically feeding the original document set, wherein said image forming means forms the image based on the original document set fed from said automatic document feeder.

9. The image forming apparatus according to claim 1, further including an automatic document feeding means for automatically feeding the original document set, wherein said image forming means forms the image based on the original document set fed from said automatic document feeder.

10. An image forming apparatus, comprising:

an image forming means for forming an image on a first-type sheet and on a second-type sheet;

a plurality of sheet receiving sections to which sheets having the image formed thereon are outputted;

an input means for inputting a number of sheets of the second-type on which the image is to be formed when the image is formed both on the first-type sheet and on the second-type sheet;

a controlling means for controlling said image forming means to form the image on the first-type sheet and to form the image on the second-type sheet, wherein the image is formed on a number of sheets of the second-type equivalent to the number input through said input means;

a sheet outputting means for outputting the first-type sheet on which the image is formed by said image forming means into a predetermined one of said sheet receiving sections;

a sheet adding means for attaching a third-type sheet onto each first-type sheet every time the first-type sheet is outputted into said predetermined sheet receiving section; and a means for sorting and outputting the sheets of the second-type on which the image is formed by said image forming means into sheet receiving sections other than said predetermined sheet receiving section, wherein, in a single image forming operation sequence, the image forming apparatus thereby produces one set of first-type sheets carrying an image corresponding to an image on an original document set, and at least one set of second-type sheets also carrying the image corresponding to the image on the original document set.

11. The image forming apparatus according to claim 10, wherein said first-type sheet is a transparent sheet for an overhead projector, said second-type sheet is a sheet of paper, and said third-type sheet is a sheet of paper.

12. An image forming apparatus for forming an image on two types of sheets, comprising:

an image forming means for forming an image on a first-type sheet and for forming the image on at least one second-type sheet;

a plurality of sheet receiving sections to which sheets formed with the image are outputted;

a means for outputting the first-type sheet on which the image is formed by the image forming means into a predetermined one of the sheet receiving sections;

a means for sorting and outputting the second-type sheets on which the image is formed by the image forming means into the sheet receiving sections other than the predetermined sheet receiving section; and a sheet adding means for attaching a third-type sheet onto each first-type sheet outputted into the predetermined sheet receiving section, wherein, in a single image forming operation sequence, the image forming apparatus thereby produces one set of first-type sheets carrying an image corresponding to an image on an original document set, and at least one set of second-type sheets also carrying the image corresponding to the image on the original document set.

13. The image forming apparatus according to claim 12, further including:

a first sheet storing means for storing a plurality of sheets of the first-type;

a second sheet storing means for storing a plurality of sheets of the second-type; and a sheet feeding means for selectively feeding the first-type sheet stored in the first sheet storing means or the second-type sheet stored in the second sheet storing means into the image forming means in association with an image forming operation of the image forming means.

14. The image forming apparatus according to claim 13, wherein the second-type sheet and the third-type sheet are of a common type.

15. The image forming apparatus according to claim 14, wherein the sheet feeding means feeds sheets stored in the second sheet storing means into the sheet adding means.

16. The image forming apparatus according to claim 13, wherein the first sheet storing means includes a manual sheet feeding tray by which sheets of the first-type are manually supplied.

17. The image forming apparatus according to claim 16, wherein the first-type sheet is a transparent sheet for an overhead projector and the second-type sheet is a sheet of paper.

18. The image forming apparatus according to claim 13, further including an automatic document feeding means for automatically feeding the original document set, wherein the image forming means forms the image based on the original document set fed from the automatic document feeder.

19. The image forming apparatus according to claim 12, further including an automatic document feeding means for automatically feeding the original document set including the image, wherein the image forming means forms the image based on the original document set fed from the automatic document feeder.

* * * * *